United States Patent [19]

Little et al.

[11] Patent Number: 4,625,657

[45] Date of Patent: Dec. 2, 1986

[54] ADJUSTABLE KEYBOARD SUPPORTING MECHANISM

[75] Inventors: Carl H. Little; Richard L. Watt, both of Jamestown, N.Y.

[73] Assignee: Weber-Knapp Company, Jamestown, N.Y.

[21] Appl. No.: 610,341

[22] Filed: May 15, 1984

[51] Int. Cl.[4] ..... A47B 57/00

[52] U.S. Cl. ..... 108/93; 108/5; 108/145; 108/138

[58] Field of Search ..... 312/27, 28, 29; 108/93, 108/5, 138, 145

[56] References Cited

U.S. PATENT DOCUMENTS

| | | | |
|---|---|---|---|
| 727,438 | 5/1903 | Piner | 108/5 |
| 1,137,261 | 4/1915 | Dyke . | |
| 1,348,924 | 8/1920 | Baskin . | |
| 1,442,664 | 1/1923 | Hansen | 108/5 |
| 1,606,975 | 11/1926 | Tobey | 312/28 |
| 1,888,034 | 11/1932 | Frankel . | |
| 2,124,754 | 7/1938 | Simpson et al. | 108/145 |
| 2,194,889 | 3/1940 | De Lisle . | |
| 2,710,782 | 6/1955 | Chaft . | |
| 3,140,559 | 7/1964 | Grow et al. . | |
| 3,425,761 | 2/1969 | Schreyer . | |
| 4,316,082 | 2/1982 | Fritz . | |
| 4,379,429 | 4/1983 | Gubbe et al. . | |
| 4,384,532 | 5/1983 | Staff . | |

*Primary Examiner*—Peter A. Aschenbrenner
*Attorney, Agent, or Firm*—Bean, Kauffman & Bean

[57] ABSTRACT

Mechanisms are disclosed for use in supporting keyboards in desired adjusted positions relative to a CRT unit supporting table or work station. A first form of the mechanism provides a retracted position for a keyboard, wherein it is disposed beneath a table top and recessed rearwardly of a front end thereof. Additional forms of the mechanism are adapted for use with work stations of the type having a generally U-shaped work surface, wherein the keyboard is intended to be supported on a shelf arranged between the opposite end, forwardly protruding surface areas of such work surface.

17 Claims, 29 Drawing Figures

Fig. 3.
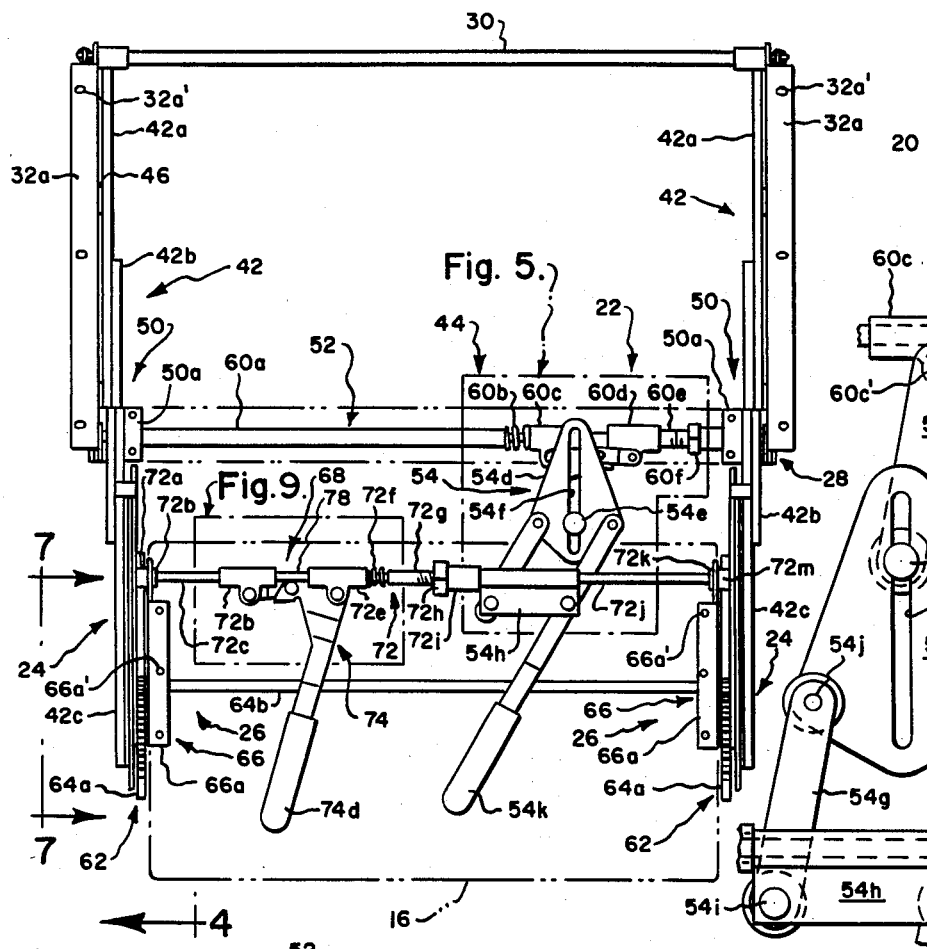
Fig. 5.
Fig. 9.
Fig. 5a.
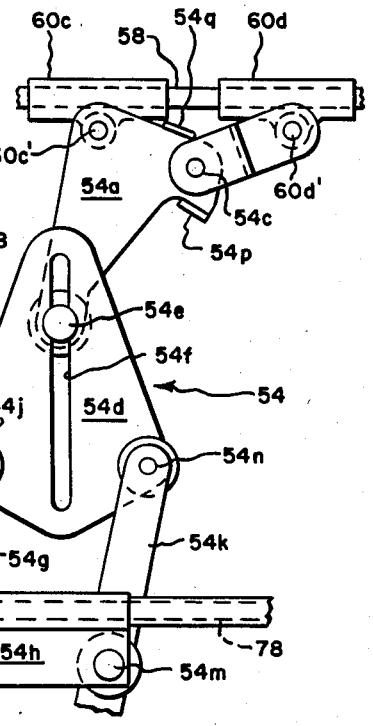
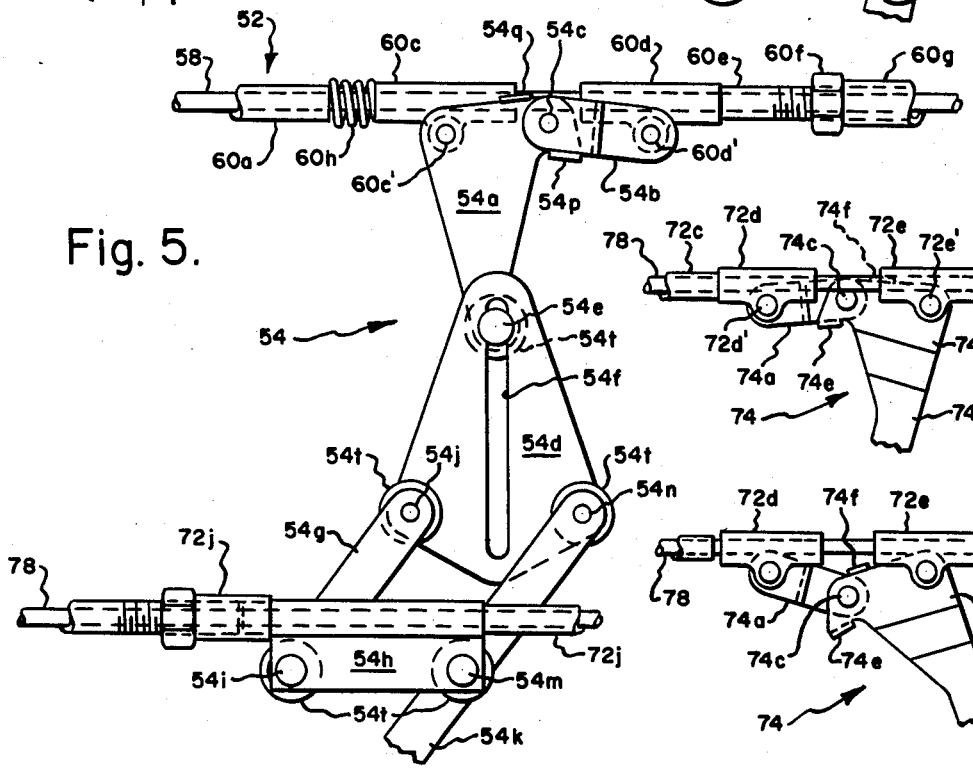
Fig. 9.
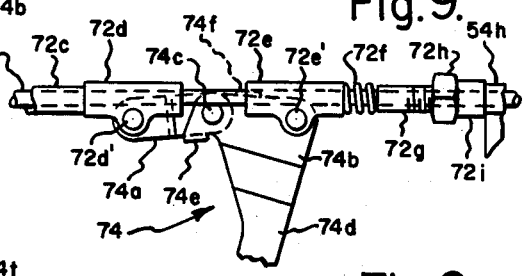
Fig. 9a.
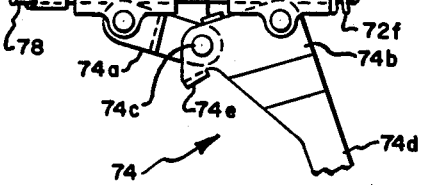

Fig. 12.
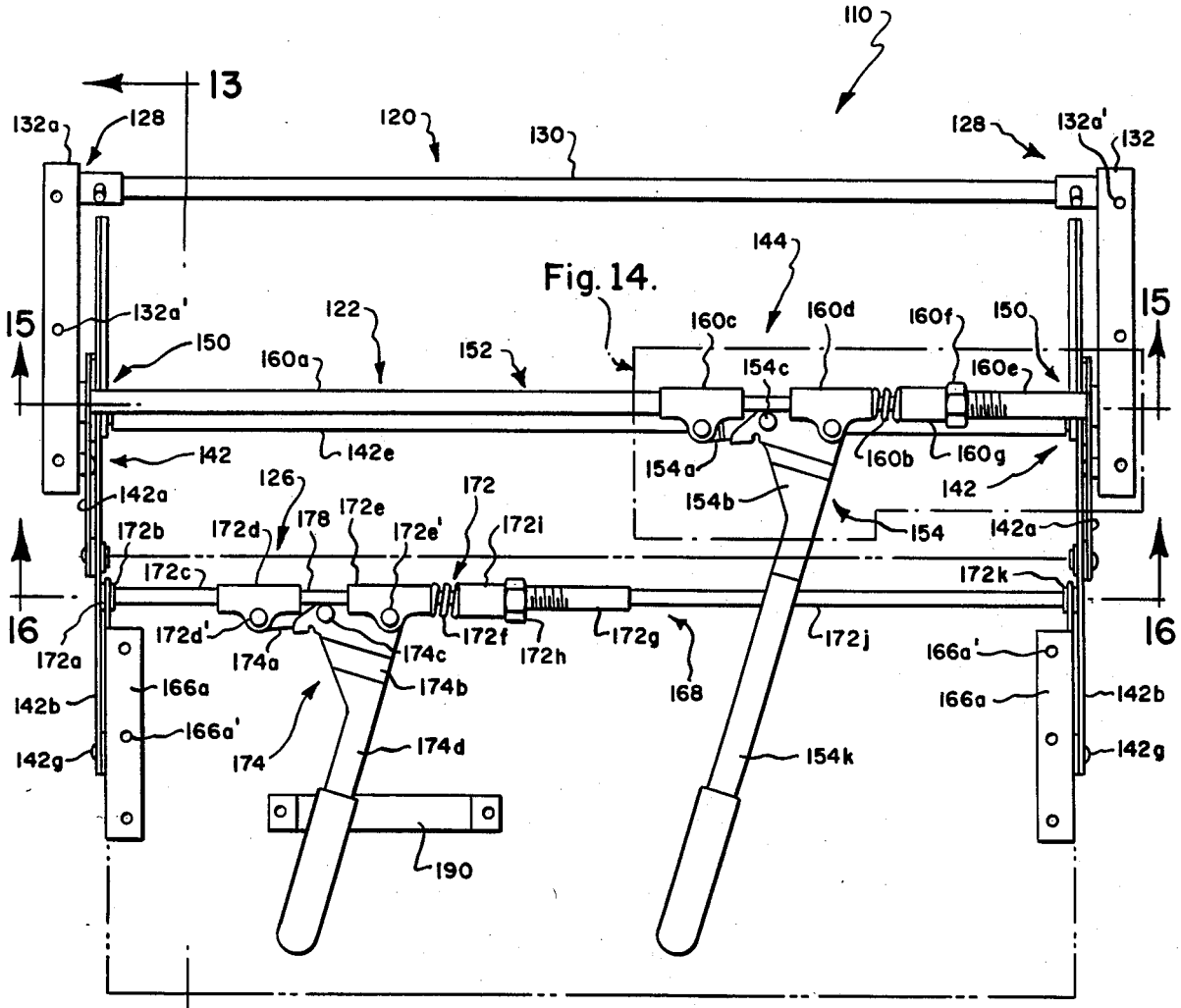
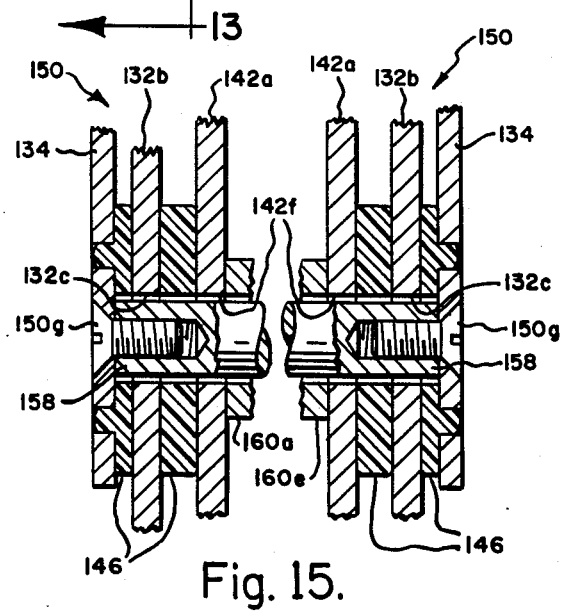
Fig. 15.
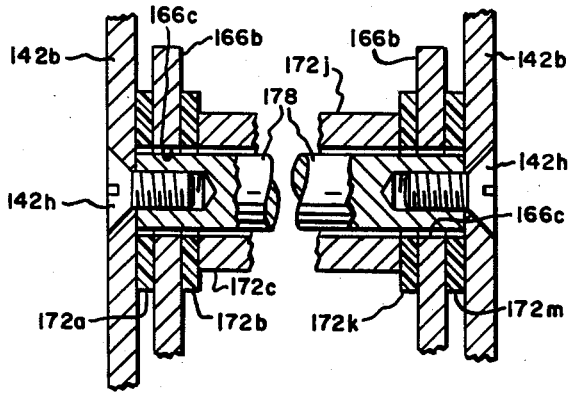
Fig. 16.

210
12
234a
238
236b
234b
236a
240
242c
242b
250a
232b
232c
246
292
258a
242
242a
236
293
234a
234
230
294
232e
232d
232h
232a
16
397
396
360a
358
332b
332c
334
330
310
336a
336
344
332e
442b
442a
432c
432b
434
446
493
434a
494
492
12a
12b
432a
442c
430
444
466
21
436
436a

ADJUSTABLE KEYBOARD SUPPORTING MECHANISM

BACKGROUND OF THE INVENTION

The present invention relates to mechanisms for supporting a keyboard in a desired adjusted position relative to a CRT unit supporting table or work station in a manner intended to minimize operator fatigue, during use of such keyboard.

Mechanisms of various types have been proposed for use in supporting keyboards or other business machines for movement between use and non-use or storage positions or to permit the use position thereof to be adjusted for purposes of minimizing operator fatigue. However, prior units of which we are aware appear to suffer from one or more drawbacks including cost of manufacture, difficulty of installation, inability to permit suspension thereof directly beneath a desk or table top without requiring alteration of the latter, limited adjustment capability and/or lack of convenient mode of adjustment.

SUMMARY OF THE INVENTION

The present invention is directed to keyboard supporting mechanisms adapted for connection to the lower surface of a desk or table top.

Various forms of the invention are described. In a first and preferred form, the mechanism permits movement of a keyboard between a storage or non-use position fully hidden below a desk or table top into a use position, wherein the vertical height, distance to operator and tilt of the keyboard may be independently adjusted. Conveniently located and independently operable handles may be used by an operator to releasably retain the keyboard at selected height and tilt orientations.

In a second form of the mechanism particularly adapted for use at generally U-shaped work stations, the keyboard is supported for fully adjustable vertical displacements between a lower or storage position and selected elevated positions, as well as for tilt and distance to operator adjustments in all vertically adjusted positions thereof. Handle operators are provided to permit an operator to releasably clamp the keyboard in selected height and tilt orientations.

A third form of the mechanism comprises a simplified version of the first form, which may dispense with separate distance to operator and/or tilt controls, as desired. This form of the invention is further simplified by replacing an operating handle with a control wheel or knob for use in clamping the keyboard in any desired vertical position.

Fourth and fifth forms of the invention comprise alternative simplified versions of the second form of the invention. In both of these forms, the distance to operator and/or tilt features of the second form may be dispensed with, as desired; and further the fifth form may be further simplified by replacing an operating handle with a control wheel or knob for use in clamping the keyboard in any desired vertical position thereof.

All forms of the invention provide a unitized assembly, including a pair of mounting brackets, which may be quickly and easily attached to the lower surface of a desk or table top without requiring modification thereof, and operator controlled clamping means movable vertically with the keyboard for releasably clamping against the brackets, as required to retain the keyboard in a desired vertical position.

Figure 1:
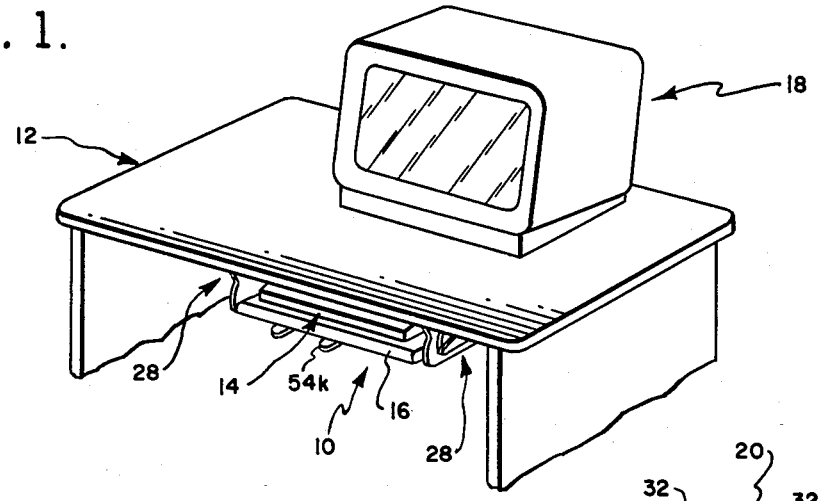
FIG. 1 is a perspective view illustrating use of one form of a support mechanism formed in accordance with the present invention for use in supporting a keyboard in a fully recessed or retracted position beneath a table top.

FIGS. *2a–2d* are views illustrating the range of positional adjustments of a keyboard afforded by the mechanism shown in FIG. 1 with portions of such mechanism being broken away for purposes of clarity;

FIG. 3 is a top plan view of the mechanism when in the keyboard adjusted position depicted in FIG. *2c;*

Figure 4:
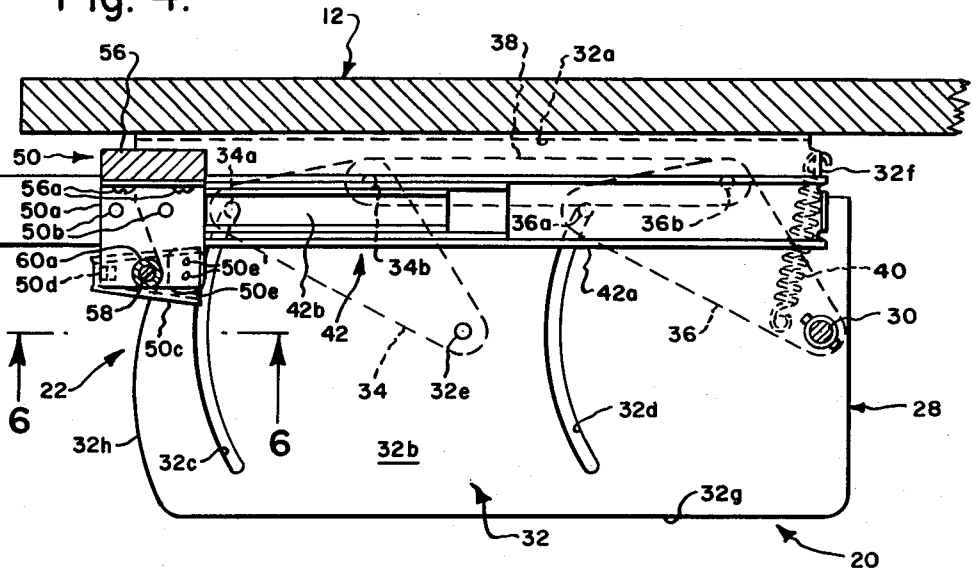

FIG. 4 is a sectional view taken generally along the line 4—4 in FIG. 3, but with the keyboard shown in a tilted position thereof;

FIG. 5 is an enlarged view of the area designated as FIG. 5 in FIG. 3 when in the keyboard adjusted position depicted in FIG. *2d;*

Figure 6:
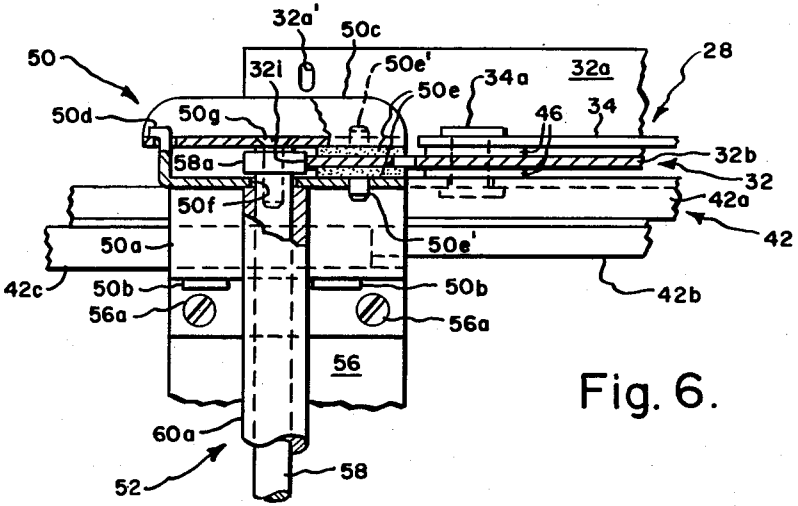
Figure 8:
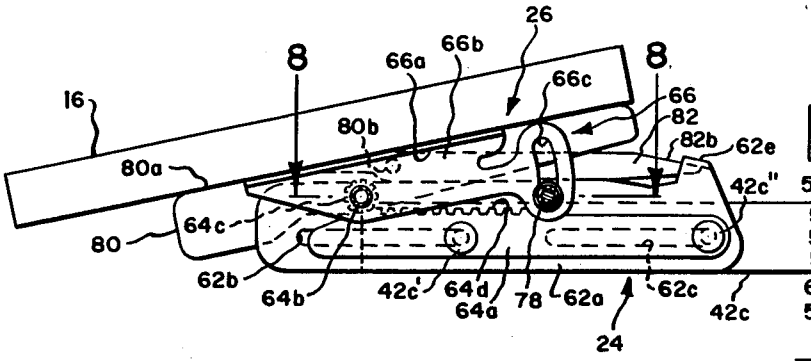
Figure 7:
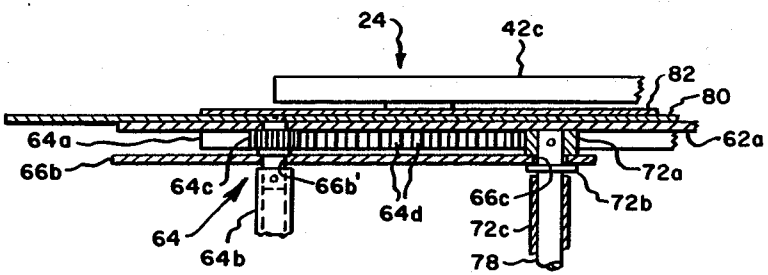
Figure 7:
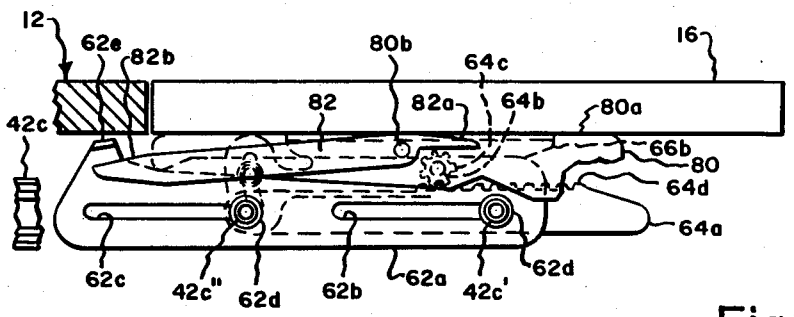
Figure 10:
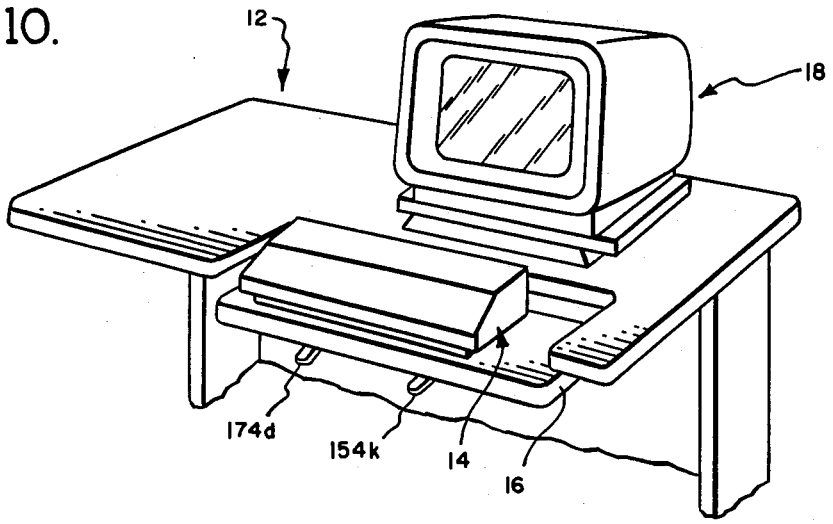
Figure 13:
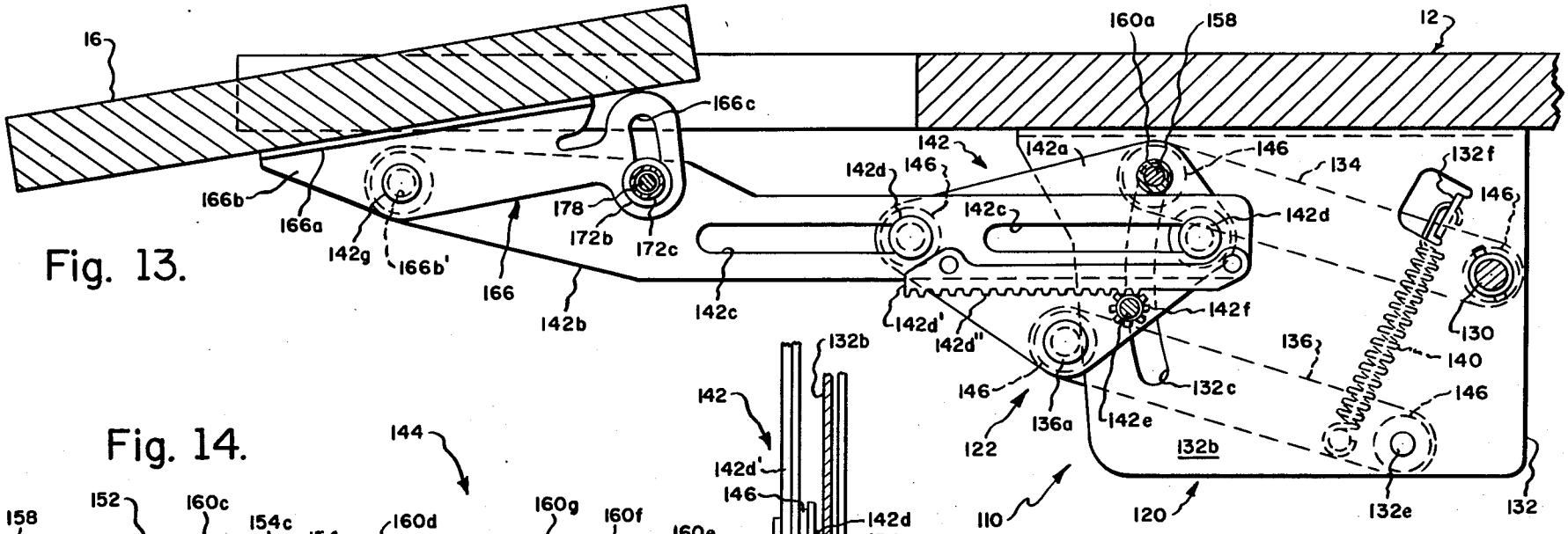
Figure 14:
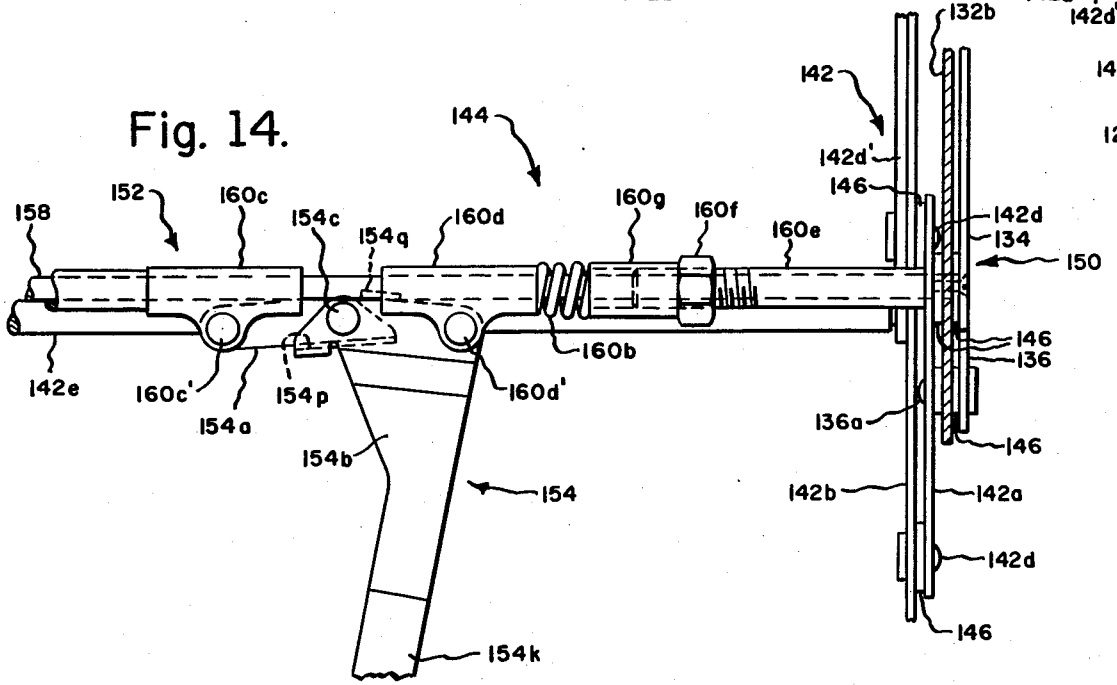
Figures 17, 18, 19, 20, 21:
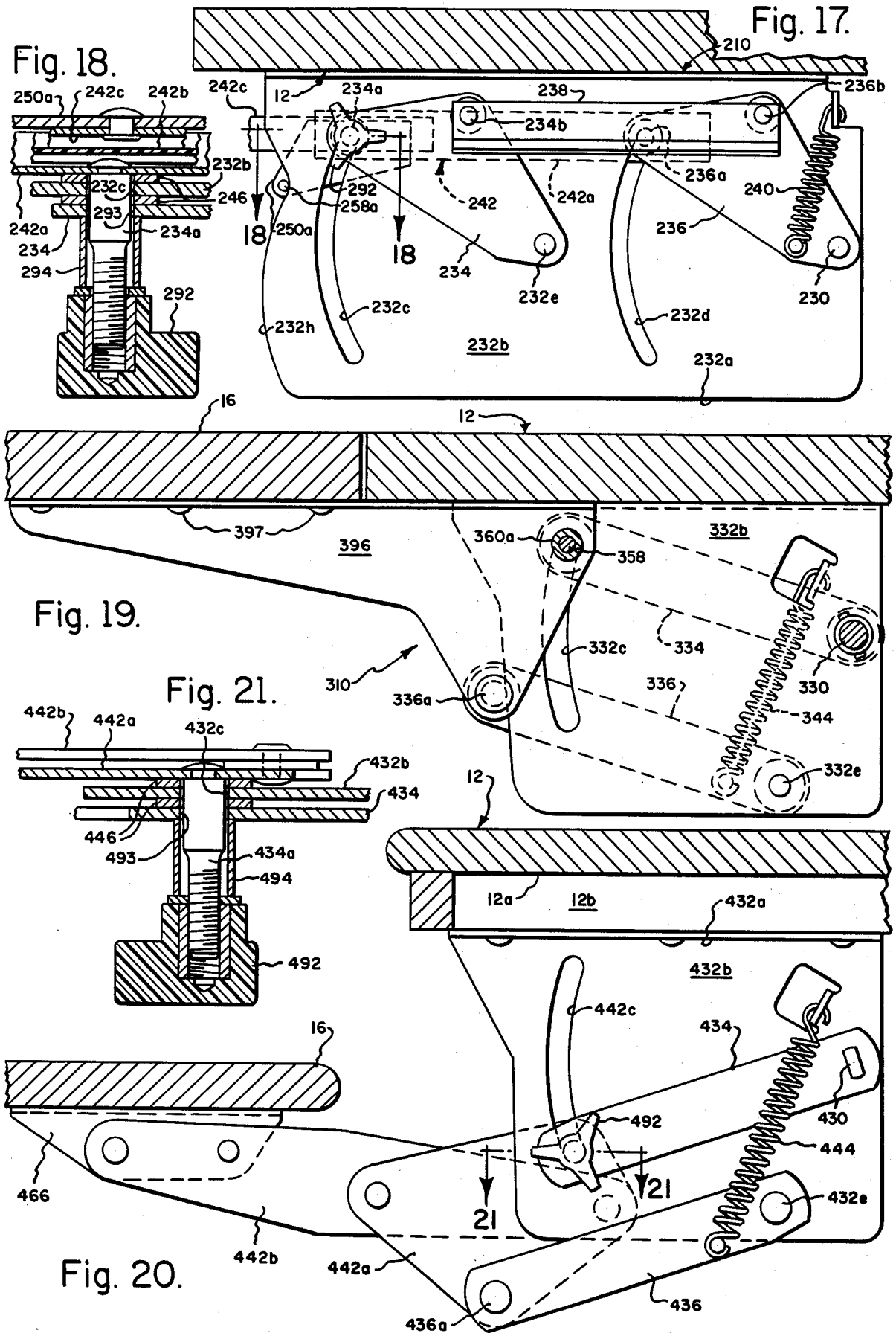

FIG. *5a* is a view similar to FIG. 5, but showing an extension and elevation control mechanism of the invention in unlocked condition;

FIG. 6 is a sectional view taken generally along the line 6—6 in FIG. 4;

FIG. 7 is a view taken generally along the line 7—7 in FIG. 3, but with the outer side part being broken away for purposes of clarity;

FIG. 8 is a sectional view taken generally along the line 8—8 in FIG. 4;

FIG. 9 is an enlarged view of the area designated as FIG. 9 in FIG. 3 showing the tilt control mechanism in locked condition;

FIG. *9a* is a view similar to FIG. 9, but showing the tilt control mechanism in unlocked condition;

FIG. 10 is a perspective view illustrating use of a second form of the support mechanism formed in accordance with the present invention for use in supporting a keyboard in association with a work station having a generally U-shaped work surface;

FIGS. *11a–11c* are views illustrating the range of positional adjustments of a keyboard supported by the mechanism of FIG. 10;

FIG. 12 is a top plan view of the mechanism of FIG. 10;

FIG. 13 is a sectional view taken generally along the line 13—13 in FIG. 12;

FIG. 14 is an enlarged view of the area designated generally as FIG. 14 in FIG. 12;

FIG. *14a* is a view similar to FIG. 14, but showing the extension and elevation control mechanism in unlocked condition;

FIG. 15 is a fragmentary sectional view taken generally along the line 15—15 in FIG. 12;

FIG. 16 is a fragmentary sectional view taken generally along the line 16—16 in FIG. 12;

FIG. 17 is a view similar to FIG. *2c,* but illustrating a third form of the support mechanism;

FIG. 18 is a sectional view taken generally along the line 18—18 in FIG. 17;

FIG. 19 is a view similar to FIG. 13, but showing a fourth form of the support mechanism;

FIG. 20 is a view similar to FIG. *11a,* but showing a fifth form of the support mechanism; and FIG. 21 is a sectional view taken generally along the line 21—21 in FIG. 20.

DETAILED DESCRIPTION

An adjustable keyboard supporting mechanism formed in accordance with a first and preferred form of the present invention is generally designated as 10 and shown in FIG. 1 as being arranged beneath a horizontal support, such as a table or desk top 12, for use in supporting a keyboard 14 via a mechanism attached shelf 16 in association with a table top supported CRT unit 18. Table top 12, keyboard 14 and CRT unit 18 may be conventional in all respects and form no part of the present invention.

Mechanism 10 is best shown in FIGS. *2a–2d*, 3 and 4 as generally comprising mounting means 20 for attaching the mechanism to the bottom surface of table top 12; and extension and elevation control mechanism 22 movably carried by the mounting means for providing a primary control of both the vertical and horizontal positioning of keyboard supporting shelf 16 and thus keyboard 14 relative to the table top; an auxiliary slide or extension control mechanism 24 for providing secondary control or fine adjustments of the horizontal positioning of the shelf; and a shelf tilt control mechanism 26.

Mounting means 20 generally comprises a pair of mounting bracket and linkage assemblies 28 and 28, which may be considered as being right and left hand units, as viewed in FIG. 3; and a torsion rod 30 extending transversely between such assemblies. In that mounting bracket and linkage assemblies 28 and 28 are of mirror image construction, only the right hand assembly best shown in FIGS. *2a–2d* will now be specifically described with like numerals being employed to designate like parts of the left hand assembly best shown in FIGS. 4 and 6.

More specifically, the right hand bracket and linkage assembly 28 comprises an L-shaped mounting bracket 32; a pair of generally triangular links in the form of front and rear links 34 and 36; an elongated connecting link 38; and a coil type counterbalance spring 40. Bracket 32 is defined as a horizontally disposed, upper mounting flange **32*a* having apertures 32*a'* for receiving bracket mounting screws, bolts or the like; and a vertically disposed, lower support flange 32*b*. Lower flange 32*b* is formed with front and rear arcuately shaped, vertically extending guide slots 32*c* and 32*d*; a mounting aperture arranged intermediate the guide slots for supporting a transversely and outwardly projecting bearing pin 32*e*; a bearing aperture arranged rearwardly of guide slot 32*d* for journaling one end of torsion rod 30; and a flange 32*f* for mounting an upper end of spring 40. Further, lower flange 32*b* has an essentially straight lower marginal or guide edge 32*g* disposed to extend essentially parallel to upper flange 32*a* and thus parallel to the lower surface of table top 12, and a front marginal or guide edge shaped to define a convex guide edge 32*h* and a concave recess or notch 32*j*. Front and rear links 34 and 36 have their rearwardly disposed ends or apex portions pivotally supported by bearing pin 32*e* and torsion rod 30, respectively, their forwardly disposed ends or apex portions fitted with guide pins 34*a* and 36*a*, which project inwardly through guide slots 32*c* and 32*d*, respectively, and their mid or upper apex portions fitted with bearing pins 34*b* and 36*b* providing pivot connections with the front and rear ends of connecting or coupling link 38, respectively. It will be understood that rear link 36 is keyed or otherwise rigidly fixed to torsion rod 30 in order to tie together or couple links 34, 36 and 38 of right and left hand assemblies 28 and 28 for conjunctive movement under the bias of their associated counterbalance springs 40** attached for example to the rear links.

Mechanism 22 generally comprises a pair of first slide assemblies 42 and 42, which may be considered as being right and left hand units, as viewed in FIG. 3, and a first clamping assembly 44 extending transversely between such assemblies. In that the slide assemblies are of mirror image construction, only the left hand unit best shown in FIGS. 4 and 6 will now be specifically described with like numerals being employed to designate like parts of the right hand unit.

More specifically, left hand slide assembly 42 comprises a conventional three part, ball bearing type telescopic slide device comprising a first or inner slide part **42*a*, which is disposed adjacent the inwardly facing surface of its associated mounting bracket 32 and has its front and rear ends pivotally coupled to front and rear links 34 and 36 via guide pins 34*a* and 36*a*, respectively; a second or intermediate slide part 42*b* slidably supported by slide part 42*a*; and a third, other or outer slide part 42*c* slidably supported by slide part 42*b*. Preferably, suitable plastic bearing rings 46 are disposed concentrically of guide pins 34*a* and 36*a* to prevent frictional engagement or sliding contact of slide part 42*a* and front and rear links 34 and 36 with the inner and outer surfaces of mounting bracket flange 32*b*, as shown in FIG. 6. Like bearing rings, not shown, would preferably be employed to minimize sliding friction between front and rear links 34 and 36 with connecting link 38**.

Clamping assembly 44 is shown in FIG. 3 as generally comprising a pair of clamping devices 50 and 50, a first telescopic tension/compression device 52, and a first manually controlled clamp operating device 54. Devices 52 and 54 define a first manually operable means for controlling operation of clamping devices 50 and 50. In that clamping devices 50 and 50 are of like mirror image construction, only the left hand one of such devices best shown in FIGS. 4 and 6 need now be described as comprising a generally W-shaped mounting/clamping bracket **50*a*, which is rigidly fixed to an associated third slide plate 42*c*, as by rivets 50*b*; an outer, generally U-shaped clamping bracket 50*c*, which is loosely hinge connected adjacent its forward end to the mounting/clamping bracket via an L-shaped tab/slot device 50*d*; and a pair of plastic guide/clamping pads 50*e* and 50*e* suitably fixed to the rearwardly disposed facing surfaces of the mounting/clamping and outer brackets, as by integrally formed mounting pins 50*e'*, to assume a straddling relationship to mounting bracket flange 32*b*. If desired, opposite ends of a brace member 56 may be fixed, as by screw devices 56*a* to the mounting/clamping brackets of clamping devices 50 and 50 to add transverse rigidity to mechanism 10**.

Tension/compression device 52 is best shown in FIGS. 5 and **5*a* as including an inner tension rod 58 and an outer, segmented compression tube assembly, which is freely slidably/rotatably mounted on the tension rod and defined for instance by a first tube 60*a*; a compression spring 60*b*; first and second bearing blocks 60*c* and 60*d*; an externally threaded second tube 60*e*; an adjustment nut 60*f* and internally threaded third tube 60*g*. Tension rod 58 has each end thereof freely slidably/rotatably supported within a bearing opening 50*f* shown only in FIG. 6 as being formed in an associated one of mounting/clamping brackets 50*a* and attached by a screw device 50*g* to abut against the relatively inner surface of an associated one of outer clamping brackets 50***c*. Preferably, a plastic follower roller 58*a* is journalled on each end of tension rod 58 intermediate associated ones of brackets 50*a* and 50*c* for rolling/bearing engagement with edge surfaces 32*g*, 32*h* and 32*j* of an associated one of mounting bracket flanges 32*b*.

Clamp operating device 54 is best shown in FIGS. 5 and 5*a* as including first and second clamping links 54*a* and 54*b*, which are pivotally connected to each other by a bearing pin 54*c* and to first and second bearing blocks 60*c* and 60*d* by bearing pins 60*c'* and 60*d'*, respectively; a motion transmitting plate 54*d*, which has its rearwardly disposed end slidably/pivotally connected to first clamping link 54*a* by means of a link mounted bearing pin 54*e* freely received within an elongated plate slot opening 54*f*; a third link 54*g* having its front and rear ends pivotally connected to one end of a support bearing block 54*h* and a front left corner of plate 54*d*, as viewed in FIG. 5, by bearing pins 54*i* and 54*j*, respectively; and an operating handle 54*k* having an intermediate portion and rear end thereof pivotally connected to an opposite end of support bearing block 54*h* and a front right corner of plate 54*d*, again as viewed in FIG. 5, by bearing pins 54*m* and 54*n*, respectively. Preferably, plastic bearing washers 54*t* are associated with bearing pins 54*e*, 54*i*, 54*j*, 54*m* and 54*n* for friction reduction purposes.

As will be apparent, bearing pin 54*c* is adapted to pass over center relative to a line drawn through the axes of bearing pins 60*c'* and 60*d'*, as links 54*a* and 54*b* are swung under the control of handle 54*k* between their locked and unlocked positions, shown in FIGS. 5 and 5*a*, respectively; wherein movement of such links beyond such locked and unlocked positions is prevented by engagement of first clamping link mounted stop tabs 54*p* and 54*q* alternatively with opposite marginal edges of second clamping links 54*b*. When links 54*a* and 54*b* are in their locked positions, bearing blocks 60*c* and 60*d* are forced relatively apart against the bias of spring 60*b*, such that the effective length of the segmented compression tube assembly is maximized relative to the fixed length of tension rod 58. As a result, the clamping pads 50*e* carried by mounting/clamping brackets 50*a* and clamping brackets 50*c* are forced outwardly and drawn inwardly against the inner and outer surfaces of mounting bracket flange 32*b*, respectively, whereby to frictionally clamp mechanism 22 in a desired adjusted position relative to brackets 32. Upon movement of links 54*a* and 54*b* towards their unlocked positions, bearing blocks 60*c* and 60*d* move relatively towards one another with the result that spring 60*b* is permitted to freely expand, so as to remove compressive force from the segmented compression tube assembly and thus free the clamping pads 50*e* from frictional clamping engagement with the mounting bracket flange 32*b*. Threaded adjustments of nut 60*f* and tube 60*g* relative to tube 60*e* serve to vary the compressive force applied to spring 60*b* upon movement of handle 54*k* into its locked position shown in FIG. 5.

Auxiliary slide mechanism 24 comprises a pair of second slide assemblies 62 and 62, which are of mirror image construction and may be considered as being right and left hand units, as viewed in FIG. 3; and a coupling device 64 extending transversely between such assemblies. Left hand second slide assembly 62 is best shown in FIGS. 4, 7 and 8 as including an elongated slide plate 62*a*, which is slidably supported on third slide part 42*c* for extension and retraction movements lengthwise thereof by means of aligned front and rear guide slots 62*b* and 62*c*, which are formed in the slide plate and sized to slidably receive front and rear bearing pins 42*c'* and 42*c''* fixed to the outer slide part and arranged to project inwardly thereof. Slide plate 62*a* is retained on bearing pins 42*c'* and 42*c''* by means of a rack plate 64*a*, which is fixed to the inwardly disposed ends of such bearing pins and forms a part of coupling device 64. Sliding friction between outer slide part 42*c*, slide plate 62*a* and rack plate 64*a* may be reduced by forming the rack plate of a suitable plastic material and employing plastic bearing/spacer rings 62*d* to separate the slide plate from the third slide part. In addition to the rack plates 64*a* associated one with each of slide assemblies 62 and 62, coupling device 64 includes a shaft 64*b* having each end thereof rotatably supported within a bearing aperture formed in an associated slide plate 62*a*; and a pair of toothed or gear wheels 64*c* and 64*c*, which are fixed for rotation with shaft 64*b* and arranged to mesh with rack teeth 64*d* formed along the upper edge of each of the rack plates.

Figure 2A:
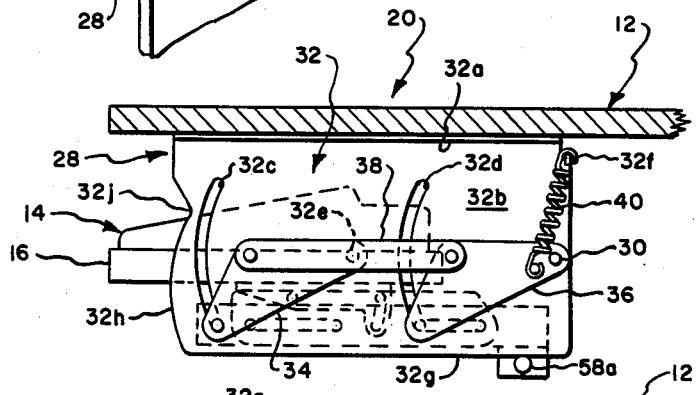
Figure 2B:
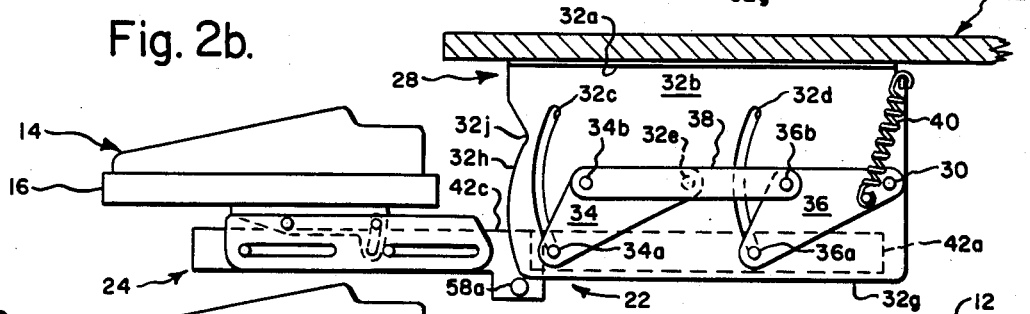
Figure 2C:
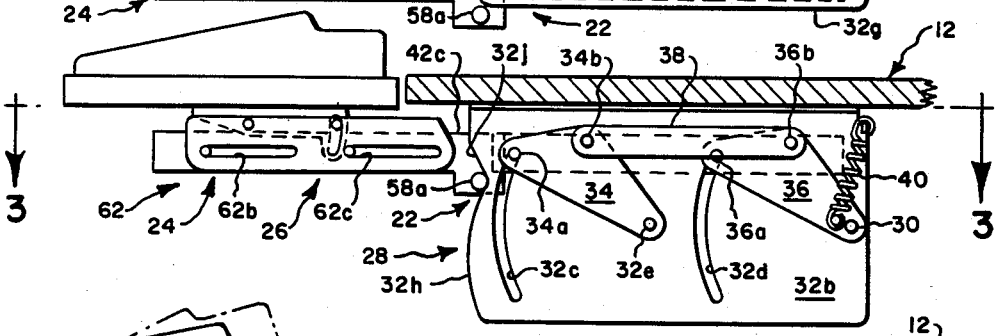
Figure 2D:
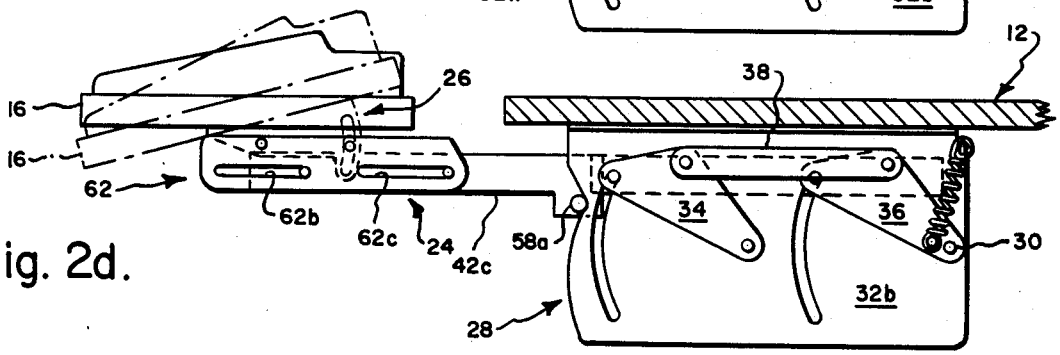

Tilt control mechanism 26 comprises a pair of shelf mounting brackets 66 and 66, which are of mirror image construction and may be considered as being right and left hand units, as viewed in FIG. 3; and a second clamping assembly 68 extending transversely between such mounting brackets for releasably clamping mounting brackets 66 and 66, and thus shelf 16 in a desired horizontal or tilted position, as indicated in full and broken line in FIG. 2*d*. Left hand bracket 66 is best shown in FIG. 4, as having an L-shaped configuration defined by an upper attachment flange 66*a* adapted for attachment to the lower surface of shelf 16, such as by threaded fasteners, not shown, received within flange apertures 66*a'* shown only in FIG. 3; and a vertically disposed mounting/tilt control flange 66*b*. Flange 66*b* is shown in FIGS. 4 and 8 and has its forwardly disposed end formed with a bearing aperture 66*b'* by which the flange is pivotally or tiltably supported on a stub shaft intermediate gear wheel 64*c* and an end of spacer tube 64*b* carrying such stub shaft and its rearwardly disposed end formed with an arcuate adjustment slot 66*c* disposed concentrically of the pivot or tilt axis of the flange defined by such stub shaft.

Second clamping assembly 68 generally comprises a second telescopic tension/compression device 72 and a second manually controlled clamp operating device 74, which cooperate to define a second manually operable means. Tension/compression device 72 is somewhat similar to previously described device 52 in that it includes an inner tension rod 78 and an outer segmented compression tube assembly mounted on the tension rod. However, in this construction, which is best illustrated in FIGS. 3, 8, 9 and 9*a*; the tube assembly is defined by a first clamping/spacer ring 72*a*; a first clamping washer 72*b*; a first tube 72*c*; first and second bearing blocks 72*d* and 72*e*; a compression spring 72*f*; an externally threaded sleeve 72*g*; an adjustment nut 72*h*; an internally threaded tube 72*i*; previously mentioned support block 54*h*; a second tube 72*j*; a second clamping washer 72*k*; and a second clamping/spacer ring 72*m*. The opposite ends of tension rod 78 freely extend through the arcuate adjustment slot 66*c* of each shelf mounting bracket 66 and are then rigidly fixed within a mounting aperture of each slide plate 62*a*. First and second clamping/spacer rings 72*a* and 72*m* are rigidly fixed adjacent the ends of tension rod 72 intermediate the associated pairs of slide plates 62*a* and shelf mounting bracket flanges 66b, as best shown in FIG. 8, while the remaining elements of the outer rube assembly are freely rotatably/slidably supported on the tension rod.

Clamping operating device 74 is shown in FIGS. 3, 9 and 9a as including first and second clamping links 74a and 74b, which are pivotally connected to each other by a bearing pin 74c and to first and second bearing blocks 72d and 72e by bearing pins 74d' and 72e', respectively; second link 74b being extended forwardly to define an operating handle 74d. Bearing pin 74c is adapted to pass over center relative to a line drawn through the axes of bearing pins 72d' and 72e', as links 74a and 74b are swung under the control of handle 74d between their locked and unlocked positions shown in FIGS. 9 and 9a, respectively, wherein movement of such links beyond such locked and unlocked positions is prevented by engagement of second link mounted stop tabs 74e and 74f alternatively with opposite marginal edges of first link 74a. Upon movement of handle 74d into its locked position, bearing blocks 72d and 72e are forced apart against the bias of spring 72f for purposes of frictionally clamping left and right hand flanges 66b between ring 72a and washer 72b and washer 72k and ring 72m, respectively. As in the case of the first clamping operation described above, movement of handle 74d into its unlocked position serves to remove compressive force applied to its associated spring 72f and adjustments of nut 72h and tube 72i relative to sleeve 72g serve to vary the compressive force to be applied to such spring upon movement of the handle into its locked position.

A desirable feature of the construction of clamp operating devices 54 and 74 is that handles 54k and 74d are permitted to overlie spacer tube 64b of coupling device 64 below shelf 16.

Reference is again made to FIGS. 4, 7 and 8, wherein a first finger protection plate 80 is shown as being pivotally supported on an end of shaft 64b projecting outwardly of slide plate 62a and as being adapted for pivotal movements with an adjacent shelf mounting bracket 66, due to engagement of its essentially straight upper edge 80a with the lower surface of shelf 16 when fixed to such mounting bracket. First plate 80 mounts an outwardly projecting bearing pin 80b, which is disposed rearwardly of the axis of shaft 64b and serves to support a second finger protection plate 82 for pivotal movements within a plane parallel to plate 80. Plate 82 has a forwardly disposed end formed with an essentially straight upper edge 82a arranged to removably underengage the lower surface of shelf 16 and the rearwardly disposed end 82b arranged to removably underengage flange 62e of slide plate 62a. By referring to FIGS. 4 and 7, it will be understood that the width or vertical dimension of first plate 80 is limited due to the placement of rear spacer ring 62d and the length of adjustment slot 66c, which in the illustrated construction permits downwardly and forwardly directed tilting movements of shelf 16, as well as the downwardly and rearwardly directed tilting movement indicated in FIG. 4. Thus, as shelf 16 is tilted towards the portion shown in FIG. 4, the lower rear edge of first plate 80 is forced to rise above the upper edge of slide plate 62a to afford a wedge shaped opening through which the fingers of an operator might be inserted and possibly pinched during return of the shelf to a horizontal position. This is avoided by the provision of second plate 82, which serves to fill or block off such wedge shaped opening automatically as an incident to tilting movement of shelf 16.

The sequence of operation of mechanism 10 will be best understood by referring to FIGS. 2a through 2d. Thus, in FIG. 2a, keyboard 14 is shown in its storage or non-use position in which it is fully retracted beneath table top 12. In this position, links 34 and 36 of each bracket and linkage assembly are retained in a lower or first extreme pivotal position thereof against the bias of spring 40, due to underengagement of roller 58a with lower guide edge 32g. Upon movement of handle 54k into its unlocked position shown in FIG. 5a, clamping pads 50e are released from clamping engagement with mounting bracket flange 32d adjacent lower guide edge 32g, so as to free slide assembly 42 for movement between its initial contracted condition shown in FIG. 2a and its extended condition shown in FIG. 2d. During extending or subsequent contracting movements of the slide assembly, roller 58a remains in engagement with the lower guide edge, so as to retain the slide assembly and thus the keyboard in lower storage positions and positively prevent unintentional lifting or vertical movement of the keyboard into engagement with table top 12, which might otherwise result in damage to the keyboard. However, upon movement of the slide assembly into extended position, roller 58a is freed from constraining engagement with the lower guide edge and may move upwardly along front guide edge 32h for eventual receipt within notch 32j, as an incident to pivotal movement of links 34 and 36 into an upper or second extreme pivotal position thereof under the bias of spring 40. Notch 32j and/or engagement of guide pins 34a and 36a with the upper ends of guide slots 32c and 32d may be employed to determine the maximum elevated position of the keyboard, whereas selective return of handle 54k to its locked position will serve to lock the keyboard in any desired vertically adjusted position intermediate the lower and upper positions shown in FIGS. 2b and 2c, respectively. As will be apparent, engagement of roller 58a and with front guide edge 32h, including notch 32j, prevents contracting movements of the slide assembly for all vertical positions of the keyboard other than its lower storage position shown in FIGS. 2a and 2b.

Once the keyboard has been locked in a desired vertical adjustment position, an operator may then make distance to operator adjustments of the keyboard, if desired, by moving the keyboard supporting shelf 16 horizontally between the extreme or limit conditions determined by the lengths of slide plate guide slots 62b and 62c, as depicted in FIGS. 2c and 2d. However, it will be noted by reference to FIGS. 3, 5 and 5a that distance to operator adjustments may be made without regard to whether handle 54k is in locked or unlocked condition, due to the mode of interconnecting motion transmitting plate 54d to first clamping link 54a of the first clamp device 54. More specifically, it will be understood that first clamping link 54a is coupled to plate 54d by bearing pin 54e, freely slidably received in plate slot opening 54f, which is always disposed essentially normal to tension rods 58 and 78, and thus aligned with the direction of distance to operator adjustments regardless of the position of handle 54k. This arrangement additionally permits distance to operator adjustments to be made regardless of whether tilt control handle 74d is in its locked or unlocked position.

Further, at any time after the keyboard has been arranged in its desired vertically adjusted position, the keyboard may be manually tilted from its normal, horizontally disposed storage position after handle 74*d* is moved into its unlocked position shown in FIG. 9*a*. Upon return of handle 74*d* to its locked position shown in FIG. 9, the keyboard is retained in a desired tilted position, such as that shown in FIG. 2*d*. However, as will be apparent from viewing FIGS. 2*a* through 2*d*, the mode of controlling vertical movements and extensions/contractions of slide assemblies 42 coupled with an appropriate range of permitted vertical adjustments of the keyboard, will allow the keyboard to be returned to and subsequently removed from its fully retracted or storage position while the keyboard remains in its previously selected tilted position.

A mechanism formed in accordance with a second form of the present invention is generally designated as 110 in FIGS. 10, 11*a*–11*c*, 12 and 13. Mechanism 110 is similar in certain respects to mechanism 10 and accordingly corresponding parts of mechanism 110 are designated by like one hundred series numerals. Thus, mechanism 110 may be considered as generally comprising mounting means 120 for attaching the mechanism to the bottom surface of table top 12; an extension and elevation control mechanism 122 movably carried by the mounting means for providing control of both the vertical and horizontal positions of keyboard supporting shelf 16 and thus keyboard 14 relative to the table top and shelf tilt control mechanism 126.

Mounting means 120 generally comprises a pair of mounting bracket and linkage assemblies 128 and 128, which may be considered as being right and left hand units, as viewed in FIG. 12; and a torsion rod 130 extending transversely between such assemblies. Bracket and linkage assemblies 128 and 128 are of mirror image construction, and accordingly, only the right hand assembly best shown in FIGS. 11*a*–11*c* will be best described with like numerals being employed to designate like parts of the left hand assembly.

More specifically, the right hand bracket and linkage assembly 128 comprises an L-shaped bracket 132; a pair of links 134 and 136; and a coil type counterbalance spring 140. Bracket 132 is defined as a horizontally disposed, upper mounting flange 132*a* having apertures 132*a'* for receiving bracket mounting screws, bolts or the like; and a vertically disposed, lower support flange 132*b*. Lower flange 132*b* is formed with an arcuately shaped, vertically extending guide slot 132*c*; a mounting aperture for supporting a transversely and outwardly projecting bearing pin 132*e*; a bearing aperture for journaling one end of torsion rod 130; and a flange 132*f* for mounting an upper end of spring 140. Links 134 and 136 have their rearwardly disposed ends pivotally supported by torsion rod 130 and bearing pin 132*e*, respectively. It will be understood that link 134 is keyed or otherwise rigidly fixed to torsion rod 130 in order to tie together or couple links 134 of right and left hand assemblies 128 and 128 for conjunctive movement under the bias of their associated counterbalance springs 140 attached for example to link 136.

Mechanism 122 generally comprises a pair of slide assemblies 142 and 142, which may be considered as being right and left hand units, as viewed in FIG. 12, and a first clamping assembly 144 extending transversely between such assemblies. In that the slide assemblies are of mirror image construction, only the left hand unit best shown in FIG. 13 will now be specifically described with like numerals being employed to designate like parts of the right hand unit.

More specifically, left hand slide assembly 142 comprises a multiple slide device comprising a first or inner slide part 142*a*, which is disposed adjacent the inwardly facing surface of its associated mounting bracket 132 and pivotally coupled to links 134 and 136; and a second or outer slide part 142*b* slidably supported by slide part 142*a*. Link 134 is pivotally coupled to inner slide part 142*a* via clamping assembly 144 to be hereinafter described, whereas link 134 is pivotally coupled to such slide part by a pin 136*a*. Slide parts 142*a* and 142*b* are slidably coupled by bearing pins 142*d* carried by the former and arranged to be slidably received within aligned slot openings 142*c* provided in the latter. Slide assemblies 142 and 142 are coupled together to insure conjunctive movements of slide parts 142*b* by means of a pair of rack plates 142*d* and 142*d* fixed one to each of slide parts 142*b* and a coupling device in the form of a shaft 142*e* having each end rotatably supported on slide part 142*a* and a pair of toothed or gear wheels 142*f* and 142*f*, which are fixed for rotation with the ends of the shaft and arranged to mesh with rack teeth 142*d'* formed along the lower edges of each of the rack plates. Thus, this construction is similar to coupling device 64. Preferably, suitable plastic bearing or spacer rings 146 are provided between the several relatively movable parts.

Clamping assembly 144 generally comprises a pair of clamping devices 150 and 150, of mirror image construction, a first telescopic tension/compression device 152, and a first manually controlled clamp operating device 154. Clamping devices 150 and 150 are of simplified construction in comparison to comparable devices 50 and 50 in that same are each defined by previously described parts including associated ones of links 134, inner slide parts 142*a* and rings 146, as best shown in FIG. 15.

Tension/compression device 152 includes an inner tension rod 158 and an outer, segmented compression tube assembly, which is freely slidably/rotatably mounted on the tension rod and defined for instance by a tube 160*a*; a compression spring 160*b*; first and second bearing blocks 160*c* and 160*d*; an externally threaded tube 160*e*; and adjustment nut 160*f* and internally threaded tube 160*g*. Tension rod 158 has each end thereof sized to be freely slidably received within slot opening 132*c* of mounting bracket flange 132*b* and rotably received within a bearing opening 142*f* formed in an inner slide part 142, and attached by a screw device 150*g* to abut against the relatively inner surface of an associated one of links 134.

Figure 14A:
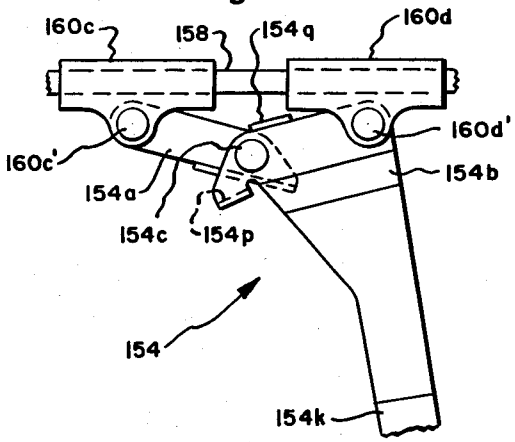

Clamp operating device 154 is shown in FIGS. 12, 14 and 14*a* as including first and second clamping links 154*a* and 154*b*, which are pivotally connected to each other by a bearing pin 154*c* and to first and second bearing blocks 160*c* and 160*d* by bearing pins 160*c'* and 160*d'*, respectively; link 154*b* being extended forwardly to define an operating handle 154*k*.

As will be apparent, bearing pin 154*c* is adapted to pass over center relative to a line drawn through the axes of bearing pins 160*c'* and 160*d'*, as links 154*a* and 154*b* are swung under the control of handle 154*k* between their locked and unlocked positions, shown in FIGS. 14 and 14*a*, respectively; wherein movement of such links beyond such locked and unlocked positions is prevented by engagement of link mounted stop tabs 154*p* and 154*q*. Thus, with this construction, movement of handle 154*k* into its locked position serves to clamp links 134 and slide parts 142*a* against opposite side surfaces of their associated support flanges 132*b;* clamping pressure being transmitted via rings 146, as best shown in FIG. 15.

In mechanism 110, the auxiliary slide mechanism of mechanism 10 is dispensed with, and tilt control mechanism 126 is mounted directly on outer slide parts 142*b* by pivot pins 142*g*. Tilt control mechanism 126 comprises a pair of shelf mounting brackets 166 and 166, which are of mirror image construction and may be considered as being right and left hand units, as viewed in FIG. 3; and a second clamping assembly 168 extending transversely between such mounting brackets. Left hand bracket 166 is best shown in FIGS. 12 and 13, as having an L-shaped configuration defined by an upper attachment flange 166*a* adapted for attachment to the lower surface of shelf 16, such as by threaded fasteners, not shown, received within flange aperture 166*a'*; and a vertically disposed mounting/tilt control flange 166*b*. Flange 166*b* has its forwardly disposed end formed with a bearing aperture 166*b'* by which the flange is pivotally or tiltably supported on pivot pin 142*g* and its rearwardly disposed end formed with an arcuate adjustment slot 166*c* disposed concentrically of the pivot or tilt axis of the flange.

Second clamping assembly 168 generally comprises a second telescopic tension/compression device 172 and a second manually controlled clamp operating device 174. Tension/compression device 172 is somewhat similar to previously described device 72 in that it includes an inner tension rod 178 and an outer segmented compression tube assembly mounted on the tension rod. However, in the illustrated construction, this latter tube assembly is defined by first clamping/spacer rings 172*a* and 172*b* arranged on opposite sides of the left hand mounting bracket flange 166*b;* a first tube 172*c;* first and second bearing blocks 172*d* and 172*e;* a compression spring 172*f;* an externally threaded sleeve 172*g;* an adjustment nut 172*h;* an internally threaded tube 172*i;* a second tube 172*j* and second clamping/spacer rings 172*k* and 172*m*. The opposite ends of tension rod 178 freely extend through the arcuate adjustment slot 166*c* of each shelf mounting bracket 166 and are then rigidly fixed to second slide parts 142*b* by screws 142*h*.

Clamp operating device 174 is shown in FIG. 12 as including first and second clamping links 174*a* and 174*b*, which are pivotally connected to each other by a bearing pin 174*c* and to first and second bearing blocks 172*d* and 172*e* by bearing pins 172*d'* and 172*e'*, respectively; second link 174*b* being extended forwardly to define an operating handle 174*d*. The operation of clamping operative device 174 is identical to previously described device 74, but permits removable clamping of brackets 166 intermediate slide parts 142*b* and tubes 172*c* and 172*j* as best shown in FIG. 16. In that mechanism 110 does not include previously described coupling device 64, which served to undersupport the outer end of handle 74*d*, mechanism 110 is required to be provided with means, such as a U-shaped bracket 190, for supporting the outer end of handle 174*d*. Bracket 190 may be suitably affixed to the lower surface of shelf 16. Further, in that mechanism 110 does not include an auxiliary slide mechanism, there is no need to accommodate for relative movement between first and second tension/compression devices 152 and 172, by providing motion transmitting plate 54*d*, and thus the forward end of handle 154*k* is simply permitted to rest on device 172.

Figure 11A:
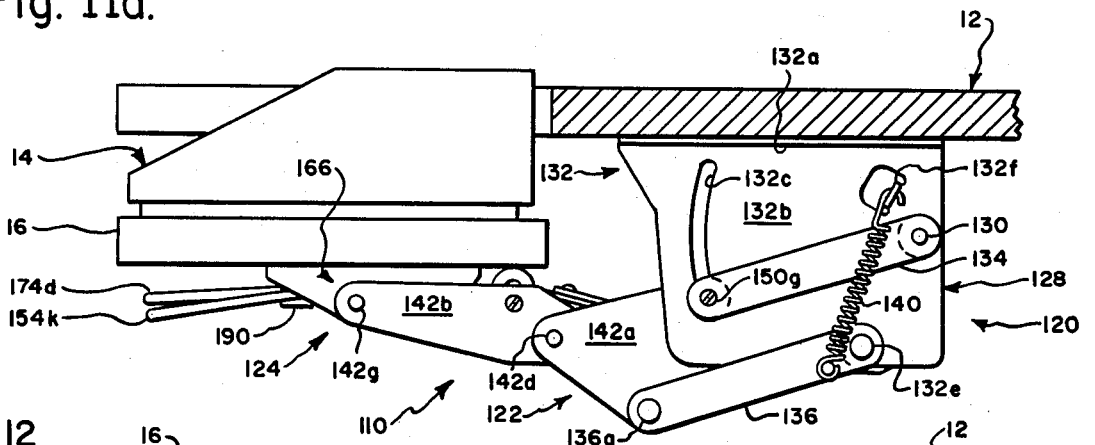
Figure 11B:
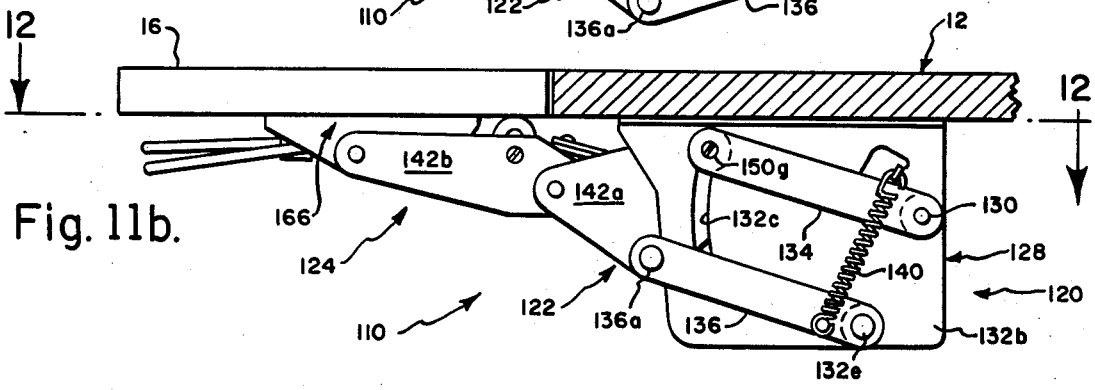
Figure 11C:
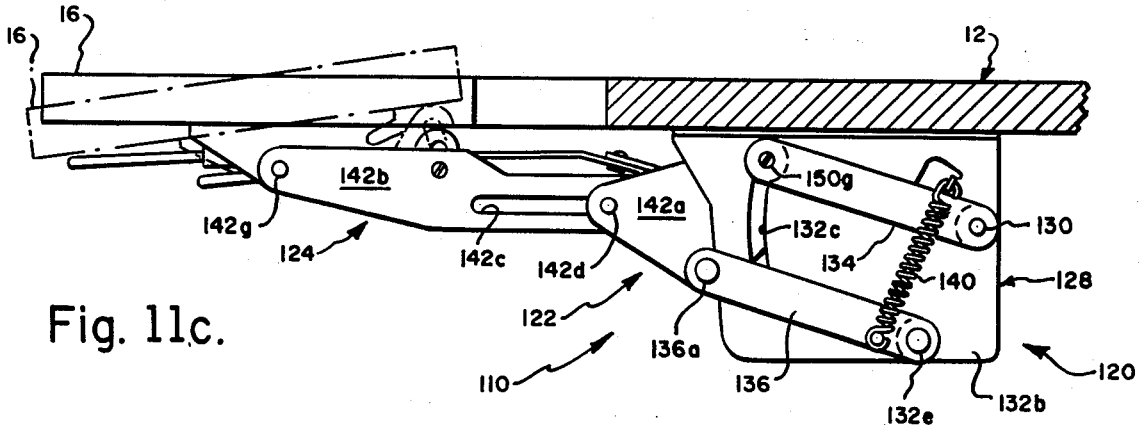

Operation of mechanism 110 differs from that of mechanism 10 in that extensions and contractions of slide assembly 142 between the extremes illustrated in FIGS. 11*a* and 11*c* provide for distance to operator control and may be effected in any vertical position of shelf 16 between the extremes illustrated in FIGS. 11*a* and 11*b*. As in the previously described mechanism, movement of handles 154*k* and 174*d* into their unlocked positions frees said shelf 16 for vertical and pivotal movements, respectively, whereas movements of these handles into their locked positions serve to clamp the shelf in desired tilt and vertical positions thereof.

A mechanism formed in accordance with a third form of the present invention is generally designated as 210 in FIG. 17. In that mechanism 210 is similar in certain respects to mechanism 10, like parts of mechanism 210 will be designated by like two hundred series numerals. The illustrated construction of mechanism 210 differs primarily from mechanism 10 in that the first clamping assembly simply comprises a pair of independently operated, clamping devices, only one of which is shown in FIG. 18 as comprising a front link guide pin 234*a* having its inner end fixed to inner slide part 242*a;* its outer end threadably coupled to hand clamping wheel 292; and its intermediate portion freely passing through rings 246, slot 232*c*, a bearing aperture 293 formed in link 234 and a bearing sleeve 294. As will become apparent from viewing FIG. 18, rotation of wheel 292 relative to guide pin 234*a* serves to releasably clamp support flange 232*b* intermediate inner slide part 242*a* and link 234 for purposes of retaining a keyboard supporting shelf, not shown, in a desired vertical position within the extremes defined by the lengths of slots 232*c* and and 232*d*.

Further, mechanism 210 is similar to mechanism 10 in that vertical movement of slide assembly 242 from a lower storage position is constrained until the slide assembly is in its extended condition, and contracting movements of the slide assembly are constrained for all vertical positions thereof other than such lower storage position. However, in mechanism 210, previously described follower roller 58*a* is replaced by a follower pin 258*a*, which is directly fixed to a bracket 250*a* carried by outer slide part 242*c*.

FIG. 19 illustrates a fourth form of the invention, which is designated as 310 and constitutes a simplified version of mechanism 110. Like parts of mechanism 310 are designated in FIG. 19 by like three hundred series numerals. In mechanism 310, the clamping assembly of mechanism 110, which is illustrated in FIGS. 12, 14 and 15, is retained, but the distance to operator control and shelf tilt control capabilities of mechanism 110 are dispensed with. In place thereof, mechanism 310 is provided with a pair of L-shaped connecting brackets 396, which have their inner ends pivotally coupled to links 334 and 336 by tension rod 358 and bearing pin 336*a*, respectively, and their outer ends fixed to shelf 16, as by screw fasteners 397. Thus, mechanism 310 is only capable of adjustably clamping shelf 16 in desired vertical positions thereof.

FIGS. 20 and 21 illustrate a fifth form of the invention, which is an alternative simplified form of mechanism 110, and thus like four number series numerals are employed to designate like parts thereof. Mechanism 410 differs from mechanism 110 in that parts 442*a* and 442*b*, which correspond to the original slide parts, are rigidly interconnected, and shelf bracket 466 is rigidly interconnected to part 442*b*. Mechanism 410 also differs from mechanism 110 in that its clamping assembly has been replaced by a simplified construction essentially identical to that described with reference to the third form of the invention depicted in FIG. 18. Specifically, such clamping assembly is shown in FIG. 21 as including front link guide pin 434*a* having its inner end fixed to part 442*a;* its outer end threadably coupled to hand operated clamping wheel 492; and its intermediate portion freely passing through rings 246, slot 432*c*, a bearing aperture 493 formed in link 434 and a bearing sleeve 494. Rotation of wheel 492 relative to guide pin 434*a* serves to releasably clamp support flange 432*b* intermediate part 442*a* and link 434 for purposes of retaining shelf 16 in a desired vertical position within the limits determined by the lengths of slots 432*c*. Further, as will be noted by reference to FIG. 20, the proximity of the upper end of slot 432*c* to upper bracket flange 432*a* makes it desirable to space such flange from the lower surface 12*a* of table top 12; so as to allow sufficient clearance for operating wheel 492 when the latter is disposed adjacent to the upper end of the slot. To this end, flange 432*a* is shown as being fixed to a spacer block 12*b*, which is suitably fixed to surface 12*a* and has a thickness sufficient to afford adequate operating clearance or spacing between wheel 492 and surface 12*a*.

What is claimed is:

1. A mechanism for mounting a keyboard for movement relative to a horizontal support, such as defined by a desk or table top, said mechanism comprising:

a pair of brackets having means for fixing said pair of brackets to depend from a lower surface of said support;

two pairs of links, wherein one of said pairs of links is pivotally supported on one of said brackets and an other of said pairs of links is pivotally supported on an other of said brackets;

means pivotally coupled to said pairs of links for mounting said keyboard for vertical movement relative to said support incident to pivotal movement of said pairs of links relative to said brackets;

spring means for at least partially counterbalancing the weight of said keyboard; and clamping means supported by said means for mounting said keyboard for vertical movement with said keyboard, and said clamping means releasably clamping against said brackets for releasably retaining said keyboard in a desired vertical position relative to said support, said means for mounting said keyboard includes telescopic slide means for supporting said keyboard for horizontal movements relative to said support, said telescopic slide means including a pair of slide mechansims each having first parts pivotally coupled one to each said pair of links and other parts for carrying said keyboard, said telescopic slide means carries means cooperating with said brackets for retaining said keyboard in a lower storage position during extending and contracting movements of said telescopic slide means, and said means cooperating with said brackets is carried by said other parts, said brackets having horizontally disposed lower guide edges and vertically extending front guide edges, and said means cooperating with said brackets includes follower means arranged to engage with said lower and front guide edges.

2. A mechanism according to claim 1, wherein said clamping means for releasably clamping against said brackets is carried by said other parts and includes a pair of clamping devices carried one by each of said other parts for clamping against said brackets and first manually operable means for operating said clamping devices, and said follower means is carried by said first manually operable means.

3. A mechanism according to claim 1, wherein an auxiliary slide mechanism is carried by said other parts for permitting further horizontal adjustments of said keyboard relative to said support and a tilt control means is mounted on said auxiliary slide mechanism for selectively retaining said keyboard in a desired tilted position relative to said support.

4. A mechanism according to claim 1, wherein an auxiliary slide mechanism is carried by said other parts for permitting further horizontal adjustments of said keyboard relative to said support, said auxiliary slide mechanism includes a pair of slide plates mounted one on each of said other parts and a coupling device for coupling said slide plates one to the other; and a tilt control means is mounted on said auxiliary slide mechanism for selectively retaining said keyboard in a desired tilted position relative to said support, said tilt control means includes a pair of shelf mounting brackets for mounting a keyboard supporting shelf and a clamping assembly extending transversely between said shelf mounting brackets, said shelf mounting brackets are supported one on each of said slide plates by said coupling device for pivotal movement about a tilt axis, and said clamping assembly is operative to releasably clamp said shelf mounting brackets against said side plates to selectively retain said keyboard in a desired titled position.

5. A mechanism according to claim 4, wherein said clamping means for releasably clamping against said brackets is carried by said other parts and includes a pair of clamping devices carried one by each of said other parts for clamping against said brackets and first manually operable means for operating said clamping devices to effect clamping of said brackets by said clamping devices, said first manually operable means includes a handle operated device supported in part by said clamping assembly and includes means permitting free relative movement of said clamping assembly relative to said first manually operable means incident to said further horizontal adjustments of said keyboard.

6. A mechanism according to claim 5, wherein said clamping asembly includes a second handle operated device supported in part by said coupling device.

7. A mechanism according to claim 6, wherein a pair of first finger protection plates are pivotally supported by said coupling device one in association with each of said shelf mounting brackets and a pair of second finger protection plates are pivotally supported one on each of said first finger protection plates, said first and second finger protection plates cooperating to prevent insertion of the fingers of a user of said keyboard between said keyboard supporting shelf and said slide plates as said keyboard is tilted about said tilt axis.

8. A mechanism for mounting a keyboard for movement relative to a horizontal support, such as defined by a desk or table top, said mechanism comprising:

a pair of brackets having means for fixing said pair of brackets to depend from a lower surface of said support;

two pairs of links, wherein one of said pairs of links is pivotally supported on one of said brackets and an other of said pairs of links is pivotally supported on an other of said brackets;

means pivotally coupled to said pairs of links for mounting said keyboard for vertical movement relative to said support incident to pivotal movement of said pairs of links relative to said brackets;

spring means for at least partially counterbalancing the weight of said keyboard; and clamping means supported by said means for mounting said keyboard for vertical movement with said keyboard, and said clamping means releasably clamping against said brackets for releasably retaining said keyboard in a desired vertical position relative to said support, said means for mounting said keyboard includes telescopic slide means for supporting said keyboard for horizontal movements relative to said support, said telescopic slide means includes a pair of slide mechanisms each having first parts pivotally coupled one to each said pair of links and other parts for carrying said keyboard, said telescopic slide means carries means cooperating with said brackets for retaining said keyboard in a lower storage position during extending and contracting movements of said telescopic slide means, and said means cooperating with said brackets is carried by said other parts, said clamping means for releasably clamping against said brackets includes at least one pin for pivotally coupling one of said first parts to one link of one of said pairs of links and a clamping wheel, at least one of said brackets includes at least one arcuate slot for slidingly receiving said pin, said pin having one end thereof fixed to said one of said first parts, extending through said slot and having an opposite end thereof threadably and adjustably mounting said wheel, whereby adjustment of said wheel relative to said pin serves to releasably clamp said one of said first parts and said one link against oppositely facing surfaces of said one of said brackets.

9. A mechanism for mounting a keyboard for movement relative to a horizontal support, such as defined by a desk or table top, said mechanism comprising:

a pair of brackets having means for fixing said pair of brackets to depend from a lower surface of said support;

two pairs of links, wherein one of said pairs of links is pivotally supported on one of said brackets and an other of said pairs of links is pivotally supported on an other of said brackets, each of said pairs of links is arranged adjacent an outwardly facing surface of said bracket on which same is pivotally supported, each of said pairs of links includes a front link and a rear link, said rear link of each pair has a rear end thereof fixed for pivotal movement with opposite ends of a torsion rod having said opposite ends thereof journalled by said brackets, said front link of each pair has a rear end thereof supported on its one of said brackets by a pivot pin arranged forwardly of said torsion rod, each of said brackets has a rear vertically extending arcuate slot disposed concentrically of said torsion bar and rearwardly of said pivot pin and a front vertically extending arcuate slot disposed concentrically of said pivot pin and forwardly thereof;

means pivotally coupled to said pairs of links for mounting said keyboard for vertical movement relative to said support incident to pivotal movement of said pairs of links relative to said brackets, said means for mounting said keyboard includes telescopic slide means for supporting said keyboard for horizontal movements relative to said support, said telescopic slide means including a pair of slide mechanisms arranged adjacent inwardly facing surfaces of said brackets and each having a first part pivotally coupled to front edges of said front and rear links of each of said pair of links by front and rear pivot pins extending one through each of said front and rear arcuate slots, and an other part for carrying said keyboard, and a pair of connecting links are provided one in association with each said pair of links, each of said connecting links having front and rear ends thereof connected to a pair of front and rear links, and said connecting links are disposed vertically below and above said torsion bar and said pivot pin when said front and rear pivot pins are disposed adjacent lower and upper ends of said front and rear arcuate slots;

spring means for at least partially counterbalancing the weight of said keyboard; and clamping means supported by said means for mounting said keyboard for vertical movement with said keyboard, and said clamping means releasably clamping against said brackets for releasably retaining said keyboard in a desired vertical position relative to said support.

10. A mechanism according to claim 9, wherein said brackets having horizontally disposed lower guide edges and vertically extending front guide edges and said other parts carry follower means cooperating with said lower guide edges for retaining said front and rear pivot pins adjacent said lower ends of said front and rear arcuate slots, during extending and contracting movements of said other parts relative to said first parts, and with said front guide edges for limiting contracting movements of said other parts relative to said first parts, while said front and rear pivot pins are disposed intermediate said lower and upper ends of said front and rear arcuate slots.

11. A mechanism according to claim 10, wherein said clamping means for releasably clamping against said brackets is carried by said other parts and includes a pair of clamping devices carried one by each of said other parts for clamping against said brackets and first manually operable means for operating said clamping devices, and said follower means is carried by said first manually operable means.

12. A mechanism according to claim 10, wherein said clamping means for releasably clamping against said brackets includes at least one of said front pivot pins carried by one of said front links and a clamping wheel, said one front pivot pin having an inner end fixed to one of said first parts and a threaded outer end adjustably mounting said wheel, whereby adjustment of said wheel relative to said one front pivot pin serves to releasably clamp said one of said first parts and said one of said front links against inner and outer surfaces of one of said brackets.

13. A mechanism for mounting a keyboard for movement relative to a horizontal support, such as defined by desk or table top, said mechanism comprising:

a pair of brackets having means for fixing said pair of brackets to depend from a lower surface of said support;

two pairs of links, wherein one of said pairs of links is pivotally supported on one of said brackets and an other of said pairs of links is pivotally supported on an other of said brackets;

means pivotally coupled to said pairs of links for mounting said keyboard for vertical movement relative to said support incident to pivotal movement of said pairs of links relative to said brackets, said brackets are each provided with at least one arcuate slot, one of said links of each pair has a rear end thereof supported for pivotal movement about an axis defined by a torsion bar extending transversely between said brackets, said slot in each said bracket is disposed concentrically of said axis, said one of said links of each said pair has its front end pivotally connected to said means for mounting said keyboard by means slidably received within said slots;

spring means for at least partially counterbalancing the weight of said keyboard; and clamping means supported by said means for mounting said keyboard for vertical movement with said keyboard, and said clamping means releasably clamping against said brackets for releasably retaining said keyboard in a desired vertical position relative to said support.

14. A mechanism according to claim 13, wherein said means slidably received within said slots includes pivot pins having inner ends fixed to said means for mounting said keyboard and outer ends threaded to adjustably receive a pair of clamping wheels, whereby adjustments of said clamping wheels relative to said pivot pins serve to releasably clamp said brackets between said means for mounting said keyboard and said one of said links of each said pair.

15. A mechanism according to claim 13, wherein said clamping means for clamping against said brackets includes a rod slidably received within said slots and having opposite ends thereof connected to said one of said links of each pair and a tube assembly disposed concentrically outwardly of said rod and having opposite ends thereof arranged to bear on said means for mounting said keyboard; and a handle operable for for effecting relative axial movements of said opposite ends of said rod and said tube assembly to releasably clamp said brackets intermediate said means for mounting said keyboard and said one of said links of each said pair.

16. A mechanism according to claim 15, wherein said means for mounting said keyboard includes a pair of slide assemblies and a coupling device, said slide assemblies having first parts pivotally coupled one to each of said pairs of links and other parts slidably supported on said first parts, said coupling device interconnecting said other parts, said keyboard is carried by said other parts and said opposite ends of said tube assembly are arranged to bear on said first parts.

17. A mechanism according to claim 16, wherein a tilt control means is mounted on said other parts for selectively retaining said keyboard in a desired tilted position relative to said support, said tilt control means includes a pair of shelf mounting brackets for mounting a keyboard supporting shelf and a clamping assembly extending transversely between said shelf mounting brackets, said shelf mounting brackets are pivotally supported one on each of said other parts for pivotal movement about a tilt axis, said clamping assembly is operable to releasably clamp said shelf mounting brackets against said other parts to selectively retain said keyboard in a desired tilted position, and said handle is supported by said tube assembly and said clamping assembly.

* * * * *